US005190157A

United States Patent [19]

Przytulla

[11] Patent Number: 5,190,157

[45] Date of Patent: Mar. 2, 1993

[54] WIDE-NECKED DRUM

[75] Inventor: Dietmar Przytulla, Kerpen, Fed. Rep. of Germany

[73] Assignee: Mauser Werke GmbH, Bruhl, Fed. Rep. of Germany

[21] Appl. No.: 698,640

[22] Filed: May 10, 1991

[30] Foreign Application Priority Data

May 31, 1990 [DE] Fed. Rep. of Germany ..... 9006150

[51] Int. Cl.[5] ..... B65D 21/02

[52] U.S. Cl. ..... 206/519; 220/669; 220/320

[58] Field of Search ..... 206/519; 220/669, 320

[56] References Cited

U.S. PATENT DOCUMENTS

| | | | |
|---|---|---|---|
| 2,686,610 | 8/1954 | Sharpnack | 220/5 |
| 2,879,917 | 3/1959 | Flack | 206/519 |
| 3,272,094 | 9/1966 | Carpenter, Jr. | 206/519 |
| 3,343,711 | 9/1967 | Godshalk | 206/519 |
| 3,609,263 | 9/1971 | Clementi | 206/519 |
| 3,648,888 | 3/1972 | Cheladze | 206/519 |
| 3,949,877 | 4/1976 | Santoni | 206/519 |
| 4,177,934 | 12/1979 | Hammes et al. | 220/319 |
| 4,231,476 | 11/1980 | Compton et al. | 206/519 |
| 4,293,073 | 10/1981 | Yates, Jr. | 206/519 |
| 4,366,696 | 1/1983 | Durgin | 72/339 |
| 4,817,801 | 4/1989 | Schwalkert | 206/519 |
| 4,828,112 | 5/1989 | Vollrath et al. | 206/519 |

FOREIGN PATENT DOCUMENTS

| | | |
|---|---|---|
| 668034 | 11/1988 | European Pat. Off. . |
| 816357 | 8/1949 | Fed. Rep. of Germany . |
| 2544491 | 4/1977 | Fed. Rep. of Germany . |
| 2431962 | 2/1980 | France . |
| 0110485 | 6/1983 | Switzerland . |

*Primary Examiner*—Joseph Man-Fu Moy
*Attorney, Agent, or Firm*—Pennie & Edmonds

[57] ABSTRACT

A bulk wide-necked drum open topped drum made from thermoplastic synthetic material for the transport of particularly dangerous liquid or solid contents. The drum body is of a lesser and conical diameter in the base portion than in the portion adjacent the top open end.

13 Claims, 2 Drawing Sheets

WIDE-NECKED DRUM

BACKGROUND OF THE INVENTION

Wide-necked open topped drums are presently available for the transport of particularly dangerous liquid or solid charges. Such drums have a barrel body portion flange at the upper open end for cooperating with a standard flanged cover and tension ring for providing a gas and liquid-proof fastening of the standard barrel cover to the drum. Such drums with standard removable covers are widely known and are used, for example, in the large-scale chemical industry on the basis of official test approvals for the various sizes of barrels (for example, 30, 60, 120 or 220 liter capacity) for the most varied of charges.

These drums with removable covers are usually of a slightly reduced barrel diameter in the upper and lower barrel portions, the central portion being of the greatest diameter. Therefore, empty drums with removable covers, particularly when used for intercontinental shipment, cannot be stacked one into the other in any great number. This consequently gives rise to high freight costs owing to the large total freight volume required.

Rain barrels manufactured out of synthetic material are also known. They comprise a completely cone-shaped barrel body, and are unsuitable for the transport of particularly dangerous liquid or solid charges since the barrel cannot be firmly sealed. The upper edge of the open end of such barrels is flanged almost rectangularly to the exterior to form a supporting surface for a barrel cover inserted into the barrel opening and resting on the flanged edge. This barrel cover cannot be fitted onto the barrel opening with a tension ring so as to be liquid-proof for lack of sealing surfaces and lack of differences in diameter of the barrel flange and cover rim. Such was not its designation anyway, since the cover comprises a non-lockable central inflow opening for the collection of rain water and, moreover, only serves to prevent particles, such as leaves, falling into the barrel.

SUMMARY OF THE INVENTION

It is the function of the present invention to provide a construction for wide-necked bulk transport drums of the type specified above which enables compact stacking of empty drums as well as savings on freight space and costs, particularly when used for intercontinental shipment. This function is fulfilled by the present invention in that the barrel body of the drum is of a lesser diameter in the base portion than in the portion of the adjacent upper open end. This change in diameter is provided by abruptly expanding the diameter of the side of the barrel body to define a step in the upper third portion of the side. The barrel side above this step is continuously substantially perpendicular relative to the plane of bottom and top of the drum.

For transport purposes, the present invention of a wide-necked drum is, in unfilled state, optimal for stacking into another drum. Hence, these drums require less freight space than transport drums of the same size, which are not able to be stacked into each other. By reason of the abrupt step-formed expansion of diameter, one drum can be inserted into another and the upper rim at the open end of the lower drum will engage the step-formed expansion of the barrel side of the upper drum to support the upper drum in stacked relation relative to the lower drum. This precludes creation of a situation in which several drums stacked into each other become almost permanently wedged or are only able to be lifted off with great effort on the part of two handlers.

Because the barrel side is continuously substantially perpendicular from the portion of abrupt diameter expansion upwards to the upper open end of the drum, the shape of the drum, from the bottom to the upper open end, only increases in diameter. There is thus, no detrimental reductions in diameter (swellings, trimmings, depressions, necking). The drum, as embodied by the invention, is therefore excellently suited for an optimal emptying of the contents, for possible cleaning and for purposes of reuse or multi-use.

DETAILED DESCRIPTION OF THE PREFERRED EMBODIMENT

Figure 1:
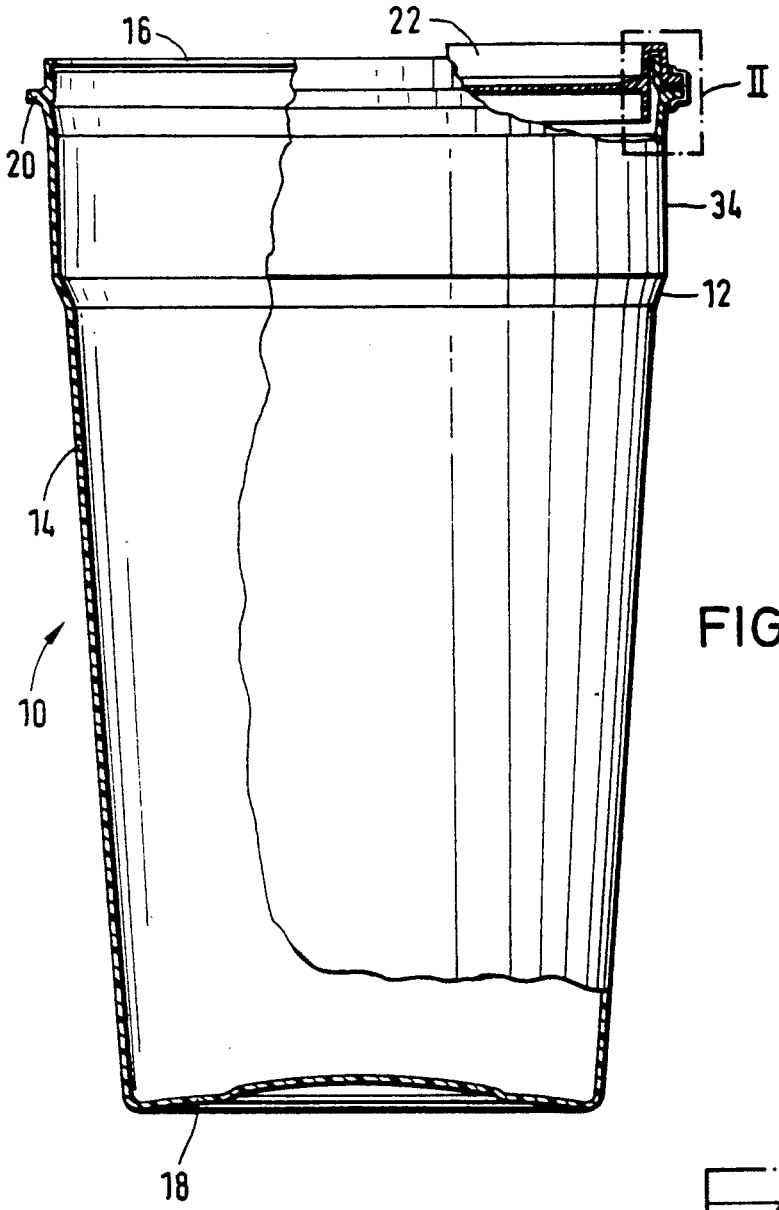
FIG. 1 is a side view, partially in cross-section, of the drum of the present invention.

Reference number 10 in FIG. 1 denotes the barrel body of a bulk wide-necked drum with a removable cover. To enable stacking of the drums for purposes of transport, the barrel body 10 is of a lesser diameter in the base 18 than adjacent the upper open end 16. At the upper third of the barrel body 10, an abrupt step-like expansion 12 of diameter is formed, the barrel side 14 being continuously substantially perpendicular relative to the drum ends from the expansion 12 upwards to the upper open end 16.

The step-like expansion 12 of the diameter defines a transition portion between the larger and smaller diameters of the side 14 and is preferably formed by a diagonally conical progression of the barrel side 14.

The upper portion of the barrel body 10 above the step-like diameter expansion 12 comprises a length less than or equal to a quarter of the total barrel height and is of cylindrical form up to the upper open end 16. The portion of the said barrel body 10 below the step-like expansion 12 is continually conical, tapering down to the bottom end or base 18 of the drum.

The base 18 is curved inwardly to a concave shape to ensure a better stability and to neutralize inner excess pressure, for example, in the center of the base.

The expansion 12 from the lesser to the larger diameter of the said barrel body 10 amounts to three to six times, preferably approximately four times the strength (thickness) of the barrel side 14 below the expansion. With a 60 liter drum manufactured of synthetic material, the strength of the barrel side, in terms of thickness, amounts to approximately 4 mm. The thickness of the barrel side of a 220 liter drum of synthetic barrel is approximately 6 mm.

Figure 2:
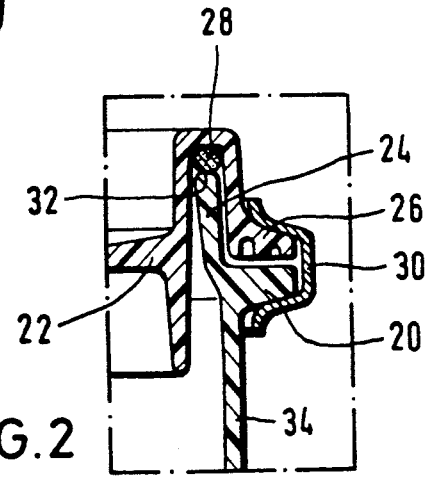
FIG. 2 shows a detailed enlargement of the upper end of the drum according to FIG. 1.

According to FIG. 2, the standard cover 22 comprises an inner lever ring engaging in the open end 16 of the drum and an outer edge overlapping the upper edge 24 of the barrel side 14. The outer flange 26 of the cover 22 extends radially away from the outer edge of the cover. When the cover is placed on the drum, a free space defining a ring recess between the inner lever ring and the outer edge of the cover accommodates a gasket 28 for sealing off the upper open end 16 of the drum.

This is accomplished by means of a tension ring 30 which secures the gasket 28 against the upper rim 32 of the upper drum edge 24 located in the ring recess.

The tension ring 30 is evenly and equally formed for reasons of function and can be stretched and secured as required without specific orientation over the flanged barrel body portion 20 of the barrel body 10 and the outer flange 26 of the barrel cover 22.

Figure 3:
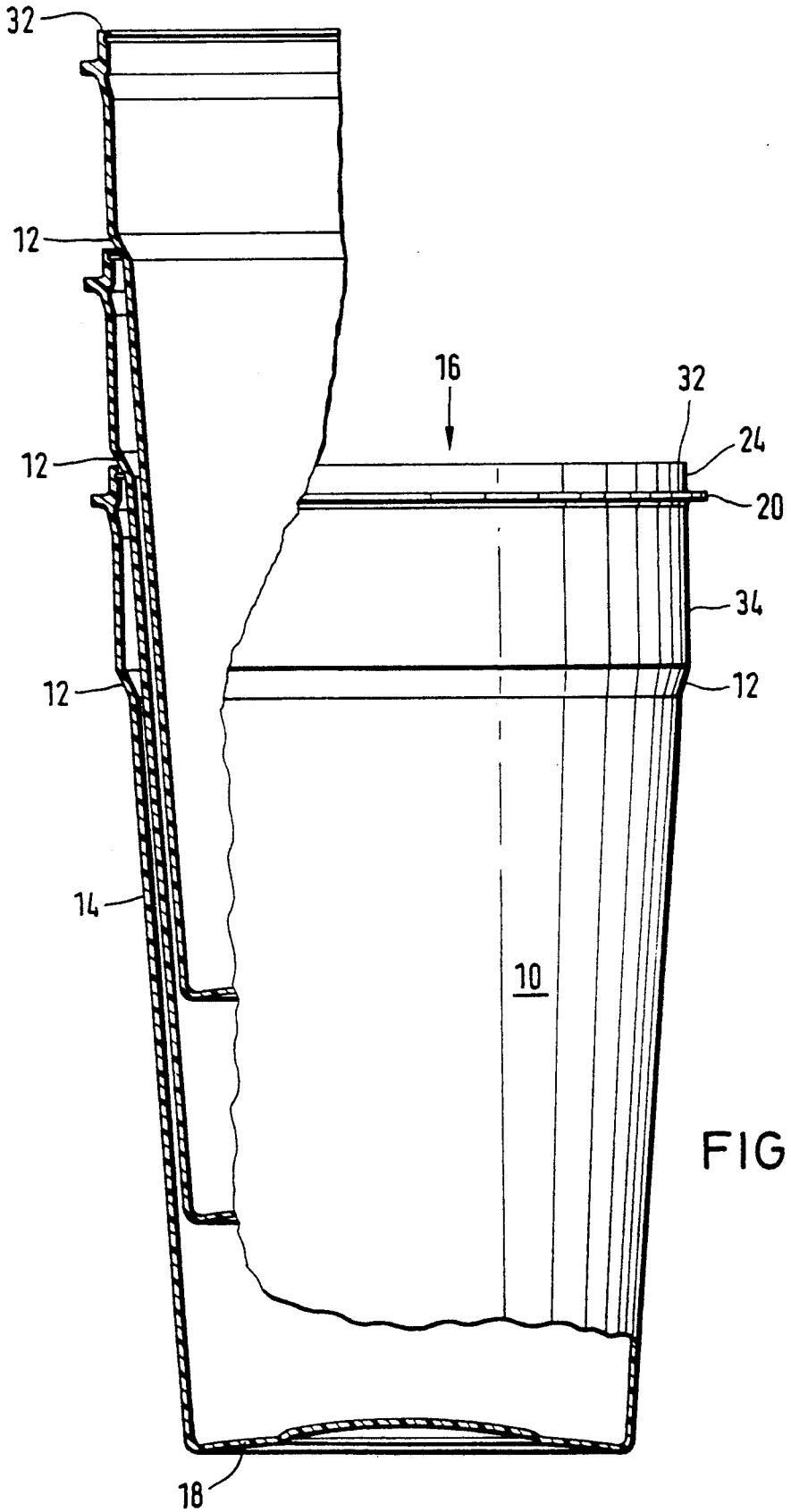
FIG. 3 is a side view, partially in cross-section, showing three drums of the present invention stacked into each other for purposes of transport.

Since the step-like expansion 12 of diameter is formed in the transition portion by the diagonally conical progression of the barrel side 14, a barrel, being stacked into another barrel, is provided with an exterior support surface or rim for seating on the upper rim 32 of the lower drum. FIG. 3 illustrates several barrels stacked into each other. Hence, an air space is retained between the interior side of the lower outer drum and the outer side of the inside drum stacked into the top of the lower drum. A partial vacuum and mutual suction of the drums, rendering them very difficult to separate, is thereby prevented with certainty.

Preferably the barrel body 10 of the drum is constructed of synthetic material and is manufactured by a blow moulding process with the barrel body flange portion 20. The synthetic barrel body 10 can, however, also be manufactured by injection moulding or rotational moulding techniques.

Another possibility is given by manufacturing the barrel body 10 by blow moulding and mounting or welding the surrounding barrel body flange 20 as a separately manufactured component on the barrel side 14.

In accordance with other possibilities in construction, provision can be made for the barrel body 10 to be comprised of sheet steel, with the barrel wall comprising at least one straight weld. Also, kraft paper can be used and the barrel body manufactured by a press-roll process.

I claim:

1. A bulk wide-necked open ended drum for the transport of particularly dangerous liquid or solid charges, having a barrel body flange portion at the upper open end for accommodating a cover and tension ring to provide gas and liquid-proof fastening of the cover to the drum characterized in that the drum includes a barrel body (10) of a lesser diameter adjacent the base portion of the barrel than adjacent the upper open end (16) and the change in diameter is defined in the upper third of the barrel body of an abrupt step-like expansion (12) of diameter, said expansion (12) of the diameter from the lesser to the larger diameter of the said barrel body (10) is being approximately four times the strength (thickness) of the side (14) of the barrel body; and the barrel body side (14) being continuously substantially perpendicular relative to the plane of the top and bottom of the drum from the diameter expansion (12) upwards to the upper open end (16) of the drum.

2. A wide-necked drum as claimed in claim 1, characterized in that the step-like expansion (12) of the diameter is formed by a diagonally conical progression of the side (14) of the barrel body in the transition portion of the said diameter expansion (12).

3. A wide-necked drum as claimed in claim 2 characterized in that the upper portion of the barrel body (10) above the said step-like expansion (12) of the diameter is cylinder-like up to the upper open end (16) of the drum.

4. A wide-necked drum as claimed in claim 3 characterized in that the portion of the barrel body (10) below said step-like expansion (12) of the diameter is formed in a continually conical shape, tapering down to the bottom (18) of the drum.

5. A wide-necked drum as claimed in claim 4 characterized in that the barrel body (10) is manufactured of synthetic material and in a blow moulding process with the barrel body flange portion (20).

6. A wide-necked drum as claimed in one of claims 1, 2, 3 and 4 characterized in that the barrel body (10) is constructed of synthetic material by an injection moulding or rotational moulding process.

7. A wide-necked drum as claimed in one of claims 1, 2, 3 and 4 characterized in that the barrel body (10) is manufactured by a blow moulding process and the surrounding barrel body flange portion (20) is a separately manufactured component mounted on to the side (14) of the barrel body.

8. A wide-necked drum as claimed in one of claims 1, 2, 3 and 4 characterized in that the barrel body (10) is constructed of sheet steel and the side of the barrel comprises at least one straight weld.

9. A wide-necked drum as claimed in one of claims 1, 2, 3 and 4 characterized in that the barrel body (10) is composed of kraft paper and manufactured by press-roll process.

10. An open-ended drum for containing and transporting dangerous liquid or solid charges, comprising:

a body having a side wall and a greater diameter adjacent the open end to allow stacking of a plurality of drums one inside another;

flange means disposed around the open end for receiving a cover and a sealing tension ring to provide a gas and liquid-proof fastening of the cover to the body; and an abrupt step-like expansion of the body around the diameter formed by an annular frusto-conical projection of the side wall, said step-like expansion being equal to between about three to six times the side wall thickness and being located in the upper third of the body, such that when the drum is stacked inside of another drum, the drum is contacted by said other drum substantially only along the step-like expansion.

11. A drum as claimed in claim 10, wherein the portion of the side wall above the step-like expansion is substantially perpendicular to the plane of the top and bottom of the drum and the side wall below the drum is substantially conical in shape, tapering down to the base of the drum.

12. A stackable drum for containing and transporting at least about sixty liters of dangerous liquid or solid charges, comprising in combination:

a cover having an outer annular flange;

a drum body having a side wall, a base and defining an open end opposite the base with an outer annular flange disposed around the open end adapted to mate with said cover flange, said body having a lesser diameter adjacent the base than adjacent the open end to enable stacking of open drums; said body further having an abrupt step-like expansion of the side wall disposed around the upper third of the body, such that when the drum is stacked inside of another drum, the drum is contacted by said other drum substantially only along the step-like expansion; wherein said expansion is equal to at least about three times the side wall thickness; and a tension ring surrounding the cover flange and the body flange and biasing said flanges together to form a gas and liquid-proof cover for the drum.

13. A stackable drum as claimed in claim 12, wherein said step-like expansion comprises a frusto-conical projection of the side wall.

* * * * *